US008147888B2

(12) United States Patent
Kling et al.

(10) Patent No.: US 8,147,888 B2
(45) Date of Patent: Apr. 3, 2012

(54) METHOD FOR THE INTELLIGENT CONTINUOUS FILLING OF A COOKING DEVICE AND COOKING DEVICE THEREFOR

(75) Inventors: Judith Kling, Landsberg (DE); Michael Greiner, Landsberg (DE); Jürgen Klasmeier, Landsberg (DE); Bernhard Schuehler, Grossaitingen (DE)

(73) Assignee: LechMetall Landsberg GmbH, Landsberg/Lech (DE)

( * ) Notice: Subject to any disclaimer, the term of this patent is extended or adjusted under 35 U.S.C. 154(b) by 645 days.

(21) Appl. No.: 12/279,962

(22) PCT Filed: Feb. 15, 2007

(86) PCT No.: PCT/DE2007/000289

§ 371 (c)(1),
(2), (4) Date: Oct. 8, 2008

(87) PCT Pub. No.: WO2007/095904

PCT Pub. Date: Aug. 30, 2007

(65) Prior Publication Data

US 2009/0274802 A1 Nov. 5, 2009

(30) Foreign Application Priority Data

Feb. 20, 2006 (DE) ..... 10 2006 008 096

(51) Int. Cl.
*A23L 1/01* (2006.01)

(52) U.S. Cl. ..... 426/233; 426/523; 99/328; 99/333; 99/344; 700/211

(58) Field of Classification Search ..... 426/231–233, 426/523; 700/211; 99/325, 327, 332, 335, 99/337, 342, 344, 333, 328
See application file for complete search history.

(56) References Cited

U.S. PATENT DOCUMENTS 3,259,056 A * 7/1966 King ..... 99/325
3,746,250 A * 7/1973 Goodhouse et al. ..... 235/61 A
(Continued)

FOREIGN PATENT DOCUMENTS

DE 43 24 015 12/1994
(Continued)

OTHER PUBLICATIONS

International Search Report for International Application No. PCT/DE2007/000289, dated Jul. 24, 2007.
(Continued)

*Primary Examiner* — Drew E Becker
(74) *Attorney, Agent, or Firm* — Marshall, Gerstein & Borun LLP

(57) ABSTRACT

A method for managing cooking programs first comprises selecting, at a point in time (t0), a type of item to be cooked (i), items (j) of the type of item to be cooked (i), and various treatment planes (k) of a cooking compartment that are to be filled at a point in time (t2) with the items (j). Then, each treatment plane (k) is filled at point in time (t2) with the items (j). Then, in dependence on at least the filling of the cooking compartment with items to be cooked at point in time (t2), a first cooking temperature is set at a point in time (t3). Then, a signal for removing the cooked items (j) from the cooking compartment is emitted at a point in time (t4*ki*) for each treatment plane (k).

22 Claims, 1 Drawing Sheet

U.S. PATENT DOCUMENTS

| | | | | |
|---|---|---|---|---|
| 4,036,995 | A * | 7/1977 | Koether et al. | 426/233 |
| 4,920,948 | A * | 5/1990 | Koether et al. | 126/21 A |
| 5,111,028 | A * | 5/1992 | Lee | 219/506 |
| 5,520,095 | A * | 5/1996 | Huber et al. | 99/332 |
| 6,299,921 | B1 * | 10/2001 | Loffler et al. | 426/233 |
| 6,773,738 | B2 * | 8/2004 | Berger et al. | 426/510 |
| 6,936,801 | B1 * | 8/2005 | Head | 219/702 |
| 6,976,004 | B2 * | 12/2005 | Wittrup | 705/15 |
| 7,102,107 | B1 * | 9/2006 | Chapman | 219/494 |
| 7,141,258 | B2 * | 11/2006 | Hillmann | 426/233 |
| 7,150,891 | B2 * | 12/2006 | Greiner et al. | 426/233 |
| 2003/0010221 | A1 | 1/2003 | Berger et al. | |
| 2005/0287253 | A1 | 12/2005 | Bucher et al. | |
| 2006/0185810 | A1 * | 8/2006 | Juergens et al. | 162/234 |
| 2007/0042091 | A1 * | 2/2007 | Rund et al. | 426/231 |
| 2008/0280000 | A1 * | 11/2008 | Breunig et al. | 426/523 |
| 2010/0186600 | A1 * | 7/2010 | Lewis et al. | 99/327 |
| 2010/0227029 | A1 * | 9/2010 | Ernst et al. | 426/231 |

FOREIGN PATENT DOCUMENTS

| | | | |
|---|---|---|---|
| DE | 100 27 072 | | 1/2002 |
| DE | 103 37 161 | | 3/2005 |
| DE | 10 2004 013 553 | | 8/2005 |
| DE | 10 2004 020 365 | | 12/2005 |
| DE | 10 2005 020 744 | | 12/2006 |
| EP | 1 275 333 | | 1/2003 |
| EP | 1 798 479 | | 6/2007 |
| GB | 2380923 | A * | 4/2003 |
| WO | WO-2005/016096 | | 2/2005 |

OTHER PUBLICATIONS

Written Opinion for International Application No. PCT/DE2007/000289 dated Jul. 24, 2007.

Translation of International Preliminary Report on Patentability for International Application No. PCT/DE2007/000289, dated Oct. 21, 2008.

* cited by examiner

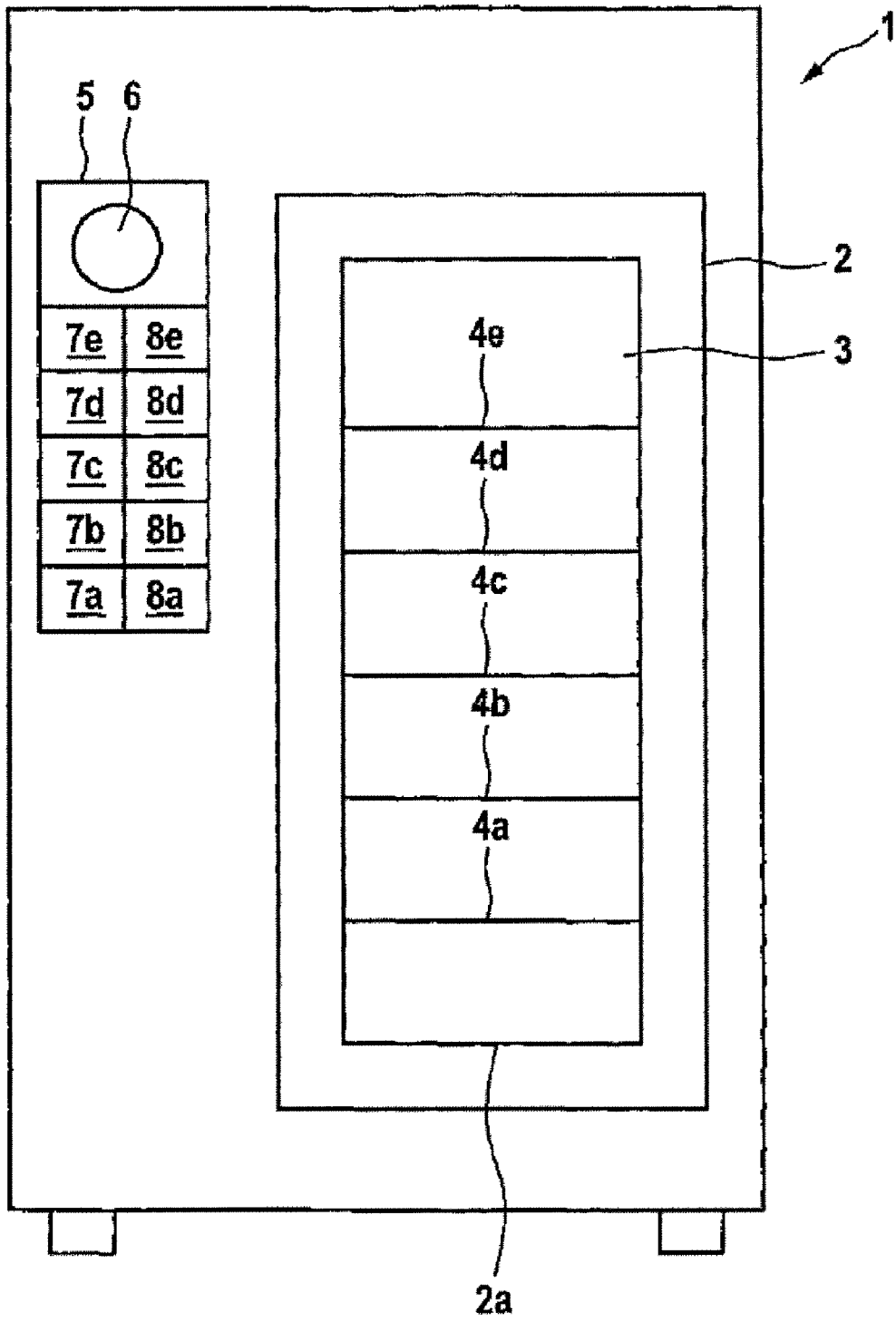
1
5
6
7e
8e
7d
8d
7c
8c
7b
8b
7a
8a
2
3
4e
4d
4c
4b
4a
2a

METHOD FOR THE INTELLIGENT CONTINUOUS FILLING OF A COOKING DEVICE AND COOKING DEVICE THEREFOR

FIELD OF THE INVENTION

The present invention relates to a method for intelligent continuous filling of a cooking chamber of a cooking appliance and, in particular, a method for conducting a cooking program by adjusting at least one cooking chamber climate in a cooking chamber of a cooking appliance for cooking products introduced into the cooking chamber at different points in time at different cooking levels, and to a cooking appliance for this purpose.

BACKGROUND

Continuous filling of a cooking appliance is of great use not only in an á la carte restaurant operation, but also for example in over-the-counter sales in bakeries or similar. For this purpose, most large kitchen cooking appliances are equipped with multiple racks, such as those known, for example, from DE 43 24 015 C1. There, a feedback system with at least one switch, a timer and an element of a loading display is provided per insert, by means of which the respective state of loading of each insert can be displayed automatically. In addition to the said display, the setting of the heating power in dependence of the state of loading of the large kitchen cooking appliance is also known from this publication.

Furthermore, DE 103 37 161 A1 discloses a method of this type for a cooking appliance for the finishing of cooking products in which continuous loading or charging can take place in such a way that different inserts in a finishing chamber are populated with cooking product at different times. When loading each insert, a timer that is assigned to the insert is manually initiated. This timer then shows a remaining time until a predetermined cooking duration in this insert is reached. A disadvantage of this cooking appliance, which has fundamentally proven itself in practice, is that mixed loading, that is, a load of the finishing chamber with different cooking products that require different courses of the cooking process, does not lead to satisfactory cooking results.

Furthermore, in DE 100 27 072 C2 a galley oven for the heating of foods is described. Guide rails can be installed in a box-shaped heating module for the loading of tray-like inserts. After loading the heating module with inserts that carry the cooking products, a duration of a cooking operation can be set with a time interval switch, and a heating process in the heating module can be started. After the elapse of the predetermined time duration, the heating process is ended. However, a disadvantage of this oven is that continuous filling and, in particular, continuous mixed loading, does not lead to reproducible cooking results of high quality.

DE 10 2004 013 553 A1 shows a cooking appliance with predetermined parameters, program and/or mode of operation. This cooking appliance makes it possible to adjust individual parameters of a cooking program set up for a given cooking product within the limits predetermined for the cooking appliance via a simple operation; however, without being able to carry out continuous loading of the cooking appliance and, in particular, in the form of a mixed load.

In the not pre-published German patent application DE 10 2005 020 744.8, a cooking method is described in which, by determining the opening angle of a cooking chamber door during the loading of the cooking chamber with cooking product, the information thus obtained is taken into consideration in subsequent cooking processes. This makes it possible automatically to adjust the subsequent program runs, when necessary, to the degree of door opening.

The selection of a suitable cooking process in dependence on a setup location of a cooking appliance and/or upon the language used in the operation of the cooking appliance is described, for example, in DE 10 2004 020 365 B3 and DE 10 2004 013 553 A1.

There is still a need for obtaining standardized cooking results even upon continuous loading, that is, loading of a cooking chamber at different times with different cooking products and with an overlap between the different loads, namely both when loading with one type of cooking product and in the case of mixed loading. It is also desirable herein to compensate for different behaviors of users by means of a cooking method. Single stage cooking methods with continuous filling should be abandoned in order to be able to take climate changes during a cooking process into consideration as well.

GENERAL DESCRIPTION OF THE INVENTION

Therefore, one object of the present invention is further to develop the method of the above mentioned type in such a way that cooking programs are carried out in a cooking chamber of a cooking appliance at different points in time in different treatment levels into which different cooking products have been introduced, in such a way that standardized cooking results of high quality are ensured.

According to the invention, the object is achieved in that different cooking products of different types can be introduced into the cooking chamber, wherein At point in time $t_0$ a type of cooking product i is selected for each cooking level k to be loaded with cooking product j at a point in time $t_2$, At point in time $t_2$ each cooking level k selected at point in time $t_0$ is loaded with the cooking product j selected at point in time $t_0$, At a point in time $t_3$, in dependence on at least the loading of the cooking chamber with cooking product at this point in time, a first cooking chamber climate is set, and for each cooking level k that is loaded with cooking product j of type of cooking product i at point in time $t_2$, a signal is output at point in time $t_{4ki}$ for removing cooking product j from the cooking chamber, wherein $t_{4ki}>t_3>t_2>t_0$ and in the case in which at point in time $t_0$ the cooking chamber is not loaded with cooking product and the cooking appliance is switched on, at point in time $t_0$ a second cooking chamber climate is determined as a function of all selectable types of cooking product i, in particular suitable for complete loading of the cooking chamber, or wherein, at a point in time $t_1$ with $t_0<t_1<t_2$ a third cooking chamber climate is determined in dependence on the type of cooking products i and cooking levels k selected at point in time $t_0$, or in the event that, at point in time $t_0$, the cooking chamber is at least partly loaded with cooking product and the cooking appliance is switched on, a fourth cooking chamber climate is determined at point in time $t_0$, at least in dependence on the loading with cooking product j, in particular on the type of cooking product i, of the cooking levels k at this point in time, or wherein at point in time $t_1$, with $t_0<t_0<t_2$, a fifth cooking chamber climate is determined in dependence on the loading at point in time $t_0$ and the loading at point in time $t_2$ with cooking product j of type of cooking product i in cooking levels k.

According to the invention, it is preferred that the first, second, third, fourth or fifth cooking chamber climate be determined and set essentially at each point in time of a cooking program and/or that the point in time $t_{4ki}$ be determined and set essentially at each point in time of a cooking program.

Furthermore, according to the invention it may be provided that the first, second, third, fourth or fifth cooking chamber climate is set via the temperature, humidity and/or the circulation of the cooking chamber atmosphere in the cooking chamber.

With the invention it is also proposed that the first, second, third, fourth or fifth cooking chamber climate be determined in dependence on the size of the cooking chamber, the geometry of the cooking chamber, the number of cooking levels in the cooking chamber, the set-up location of the cooking appliance, a selected language for operating the cooking appliance, the type of heating of the cooking chamber, the type of humidification of the cooking chamber, the flow resistance in the cooking chamber, the flow velocity in the cooking chamber, the amount of cooking product in the cooking chamber, the placement of cooking product in the cooking chamber, the type of cooking product in the cooking chamber, the temperature in the cooking chamber, the temperature of the cooking product in the cooking chamber, in particular the core temperature of the cooking product in the cooking chamber, the humidity in the cooking chamber, a selected cooking program, the degree of opening of a cooking chamber door, the frequency of opening of a cooking chamber door, and/or the duration of opening of a cooking chamber door.

Furthermore, it can be provided that the point in time $t_{4ki}$ is determined in dependence on the cooking chamber climate, the type of cooking product i of cooking product j, the position of the cooking product j at a cooking level k, the size of the cooking chamber, the geometry of the cooking chamber, the number of cooking levels in the cooking chamber, the set-up location of the cooking appliance, a selected language for operating the cooking appliance, the type of heating of the cooking chamber, the type of humidification of the cooking chamber, the flow resistance in the cooking chamber, the flow velocity in the cooking chamber, the amount of cooking product in the cooking chamber, the placement of cooking product in the cooking chamber, the type of cooking product in the cooking chamber, the temperature in the cooking chamber, the temperature of the cooking product in the cooking chamber, in particular the core temperature of the cooking product the cooking chamber, the humidity in the cooking chamber, a selected cooking program, the degree of opening of a cooking chamber door, the frequency of opening of a cooking chamber door, and/or the duration of opening of a cooking chamber door According to the invention it is proposed that when selecting a type of cooking product i, at least one first parameter stored for it be retrieved for the determination of the cooking chamber climate and/or of the point in time $t_{4ki}$.

Herein it can be provided that the first parameter is selected from the temperature in the cooking chamber, the humidity in the cooking chamber and/or the circulation of the cooking chamber atmosphere.

With the invention it is also proposed that when selecting each cooking level k, at least one second parameter stored for this level be retrieved.

Herein it can again be provided that the second parameter is selected from the temperature in the cooking chamber, the humidity in the cooking chamber and/or the circulation of the cooking chamber atmosphere in the cooking chamber.

Furthermore, it can be provided that the selection of the type of cooking product i and/or the cooking product j occurs in at least two selection stages, in particular in at least one first selection stage, at least one larger group, such as bakery goods, meat, fish or vegetables, and/or in a second selection stage at least one subgroup, in particular of the selected larger group, such as bread dough, cake dough or cookie dough, or roasts, minced meat or poultry, is selected Finally, it is proposed for the method of the invention that when loading each cooking level k, a timer this timer assigned to this cooking level k be re-set or set to zero.

With the invention, a cooking appliance is also provided with a cooking chamber with multiple cooking levels, at least one memory unit, at least one control and/or regulating unit, at least one input unit and at least one output unit for performing a method according to the invention.

Herein it may be provided that at least one timer is assigned to each cooking level has, which preferably can be operated via the input unit, wherein in particular the time counted by each timer can be displayed on the output unit.

Furthermore, the cooking appliances according to the invention are characterized by at least one sensor for the detection of the temperature in the cooking chamber, at least one sensor for the detection of the humidity in the cooking chamber, at least one sensor for the detection of the circulation of the cooking chamber atmosphere in the cooking chamber, at least one sensor for detecting a flow resistance in the cooking chamber, at least one sensor for detecting the loading of the cooking chamber with cooking product and/or cooking product carriers, at least one sensor for the detection of the opening of a cooking chamber door, comprising a degree of opening, a frequency of opening and/or a duration of opening, and/or at least one sensor for the detection of a cooking product temperature.

Further developments may also be characterized by at least one heating device of at least one heating type, in particular selected from an electrical, gas and/or microwave heater, and/or with the use of a heat accumulator.

Finally, further developments are proposed by the invention that are characterized by at least one humidifying device comprising a vapour generator and/or an injector.

Thus, the invention is based on the surprising finding that even with continuous filling, an ideal cooking chamber climate can be set at any point in time, enables a flexible handling of a cooking appliance, in particular with mixed loading, without the need for making manual corrections, in order to obtain desired cooking results.

BRIEF DESCRIPTION OF THE DRAWINGS

Further characteristics and advantages of the invention follow from the description given below, in which exemplary embodiments of the invention are explained with reference to the following:

FIG. 1 is a top plan view of a cooking appliance according to the invention.

DETAILED DESCRIPTION

The cooking appliance 1 shown in the FIGURE comprises a door 2 for closing a cooking chamber 3, in which five inserts 4*a* to 4*e* of an oven rack are arranged, as can be seen through a transparent door part 2*a*. These inserts 4*a* to 4*e* define five cooking levels. The cooking appliance 1 also comprises an operating unit 5 with a control element 6, five input elements 7*a* to 7*e* and five display elements 8*a* to 8*e*, wherein each insert 4*a* to 4*e* has an input element 7*a* to 7*e* and a display element 8*a* to 8*e* assigned to it. Using the input elements 7*a* to 7*e*, five timers, which are not shown, can be operated, whereby each insert 4*a* to 4*e* has a timer assigned to it. Furthermore, the cooking appliance has a control unit, not shown, in association with a memory unit, not shown, a temperature sensor in the cooking chamber, not shown, and a humidity sensor in the cooking chamber, not shown, and the operating unit.

If the cooking appliance 1, which can be for example a combi-steamer in which the cooking product can be prepared using hot air and/or vapour, is needed in a bakery, then from the programs stored in the memory unit, bread dough preparation programs can be called up by inputting the type of cooking product "bread dough". Hereby the selection of the type of cooking product can be sub-classified arbitrarily. For example, first a larger group, such as bakery goods, meat, fish or vegetable can be selected, and then, for example, a first subgroup, such as bread dough, cake dough or cookie dough, can be selected, for example, if the selected larger group was bakery good, and then for example a second subgroup such as whole wheat dough, yeast dough, white bread dough can be selected, for example, when the first subgroup bread dough was selected. The skilled person will recognize that the extent of subdivision for selecting the type of cooking product has no limits, in particular, an arbitrarily large number of groups and/or subgroups can be set up. In this way, the type of cooking product can be selected even more accurately in order to call up specific cooking programs, as may be suitable for the preparation of rolls, white bread, brown bread, pretzels or similar.

When an operator starts the cooking appliance 1, all timers are set to zero and the cooking appliance 1 automatically heats cooking chamber 3 to a first temperature in a preheating phase. The first temperature chosen hereby provides in the case of subsequent full loading of the cooking appliance 1 that sufficient energy is available within an acceptable time period without it being damaging to a partial load.

If during the preheating phase at point in time $t_0$ one load, with a given, not shown, cooking product, is selected by an operator for each insert 4*a* to 4*e* to be loaded, for example rolls in the second insert 4*b* and white bread in the fifth insert 4*e*, then the cooking appliance 1 calculates as well as sets automatically at point in time $t_1>t_0$ a second cooking chamber climate based on this loading with a second temperature. This second temperature is below the first temperature, since only a partial loading is performed.

If then the selected cooking product is introduced into the selected inserts 4*b*, 4*e* at point in time $t_2$ and the timers belonging to the inserts 4*b*, 4*e* are activated by the input elements 7*b*, 7*e*, then a third cooking chamber climate as well as a point in time $t_{4,2nd\ insert\ rolls}$ and $t_{4,5th.insert\ white\ bread}$ are calculated, namely in dependence on the second cooking chamber climate and the loading at point in time $t_2$. The third cooking chamber climate is hereby determined by a third temperature and a first humidity, since during the preparation of rolls and white bread a misting is to be performed. The third cooking chamber climate then exists until point in time $t_3$.

If before the run of the shorter time duration of $t_{4,2nd\ insert\ rolls}$ and $t_{4,5th.insert\ white\ bread}$ the door 2 of the cooking chamber is opened for further loading of cooking chamber 3, for example, with the pretzels, not shown, in the third insert 4*c*, then the cooking chamber climate and the points in time $t_{4,2nd\ insert\ rolls}$ and $t_{4,5th.insert\ white\ bread}$ will be recalculated as a function of the degree of opening and the duration of opening of the cooking chamber door 2 as well as the change of the load by introducing pretzels in the third insert 4*c*. In addition, a point in time $t_{4,3rd\ insert\ pretzels}$ is calculated, namely in dependence on the third cooking chamber climate and on the load of the cooking chamber 3 at this point in time.

Upon reaching the point in time $t_{4,2nd\ rack\ rolls}$, a signal is given to the operator, for example by the blinking of display element 8*b*, whereby analogous signals are is shown upon reaching points in time $t_{4,3rd\ insert\ pretzels}$ and $t_{4,5th\ insert\ white\ bread}$ on the display elements 8*c* and 8*e*. Then the finished cooked products can be removed one after the other from the cooking chamber 3. The timers automatically set to zero each time a respective cooking product is removed.

Although the invention was explained using cooking products of the type "bread dough" in the exemplary embodiments referred to above, naturally the invention is not restricted to this type of cooking product, but rather the method according to the invention and the cooking appliance according to the invention permit the use of any arbitrary type of cooking product, such as meat, baked goods or vegetables and/or combinations of various types of cooking products.

The features of the invention disclosed in the above specification, in the claims as well as in the drawing, can be essential both individually as well as in any arbitrary combination for the realization of the invention in its various embodiments.

We claim:

1. Method for conducting a cooking program by setting at least one cooking chamber climate in a cooking chamber of a cooking appliance for cooking products introduced into the cooking chamber at various points in time at different cooking levels, wherein different cooking products of different cooking product types can be introduced into the cooking chamber, the method comprising:

(a) inputting into an input device of the cooking appliance, at a point in time $t_0$, a selected type of cooking product i, a selected cooking product j of the type of cooking product i, and at least one selected cooking level k in the cooking chamber to be loaded with the cooking product j at a point in time $t_2$, with $t_2>t_0$, (b)(i) in the event that at the point in time $t_0$ the cooking chamber is not loaded with cooking product and the cooking appliance is switched on at the point in time $t_0$, the method further comprises at least one of:

(A) automatically determining a first cooking chamber climate at the point in time $t_0$, the first cooking chamber climate determined as a function of all selectable types of a cooking product i, or (B) automatically determining a second cooking chamber climate, at a point in time $t_1$ with $t_0<t_1<t_2$, the second cooking chamber climate determined in dependence on the type of cooking product type i and the at least one cooking level k input at the point in time $t_0$; or (b)(ii) in the event that, at the point in time $t_0$, the cooking chamber is at least partially loaded with a cooking product other than the selected and input cooking product and the cooking appliance is switched on, the method further comprises at least one of:

(A) automatically determining a fourth cooking chamber climate, at the point in time $t_0$, the fourth cooking chamber climate determined at least in dependence on the at least partial loading of the cooking levels k with the cooking product j at the point in time $t_0$, or (B) automatically determining a fifth cooking chamber climate, at the point in time $t_1$ with $t_0<t_1<t_2$, in dependence on the loading at the point in time $t_0$ and the cooking product j to be loaded in cooking levels k at the point in time $t_2$, (c) loading, at the point in time $t_2$, the at least one selected cooking level k input at the point in time $t_0$ with the cooking product j input at the point in time $t_0$, (d) automatically setting a third cooking chamber climate, at a point in time $t_3$, with $t_3>t_2$, in dependence on the input at the point in time $t_0$, and (e) automatically outputting a signal, at a point in time $t_4$, with $t_4>t_3$, for removing, from the cooking chamber, the cooking product j loaded at the point in time $t_2$.

2. The method of claim 1, wherein (b)(i)(A) automatically determining a first cooking chamber climate comprises automatically determining a first cooking chamber climate that is suitable for complete loading of the cooking chamber.

3. The method of claim 1, wherein (b)(ii)(A) automatically determining a fourth cooking chamber climate comprises automatically determining a fourth cooking chamber climate in dependence on the type of cooking product i.

4. The method of claim 1, further comprising at least one of:

(a) automatically determining and setting the at least one of the first, second, third, fourth, and fifth cooking chamber climate, and (b) automatically determining and setting the point in time $t_4$.

5. The method of claim 4, comprising setting the first, second, third, and fourth cooking chamber climate via at least one of the temperature, the humidity, and the circulation of the cooking chamber atmosphere in the cooking chamber.

6. The method of claim 1, comprising determining the first, second, third, fourth, and fifth cooking chamber climate in dependence on at least one of the following:

(a) a size of the cooking chamber, (b) a geometry of the cooking chamber, (c) a number of cooking levels in the cooking chamber, (d) a set-up location of the cooking appliance, (e) a language selected for operating the cooking appliance, (f) a type of heating of the cooking chamber, (g) a type of humidification of the cooking chamber, (h) a flow resistance in the cooking chamber, (i) a flow velocity in the cooking chamber, (j) an amount of cooking product in the cooking chamber, (k) a placement of cooking product in the cooking chamber, (l) a type of cooking product of the cooking product in the cooking chamber, (m) a temperature in the cooking chamber, (n) a temperature of the cooking product in the cooking chamber, (o) a humidity in the cooking chamber, (p) a selected cooking program, (q) a degree of opening of a cooking chamber door, (r) frequency of opening of a cooking chamber door, and (s) a duration of opening of a cooking chamber door.

7. The method of claim 6, wherein (n) a temperature of the cooking product in the cooking chamber comprises a core temperature of the cooking product in the cooking chamber.

8. The method of claim 1, comprising determining the point in time $t_4$ in dependence on at least one of the following:

(a) a cooking chamber climate, (b) the type of cooking product i of the cooking product j, (c) a position of the cooking product j at a cooking level k, (d) size of the cooking chamber, (e) a geometry of the cooking chamber, (f) a number of cooking levels in the cooking chamber, (g) a set-up location of the cooking appliance, (h) a language selected for operating the cooking appliance, (i) a type of heating of the cooking chamber, (j) a type of humidification of the cooking chamber, (k) a flow resistance in the cooking chamber, (l) a flow velocity in the cooking chamber, (m) an amount of cooking product in the cooking chamber, (n) a placement of cooking product in the cooking chamber, (o) a type of cooking product of the cooking product in the cooking chamber, (p) a temperature in the cooking chamber, (r) a temperature of the cooking product in the cooking chamber, (s) a humidity in the cooking chamber, (t) a selected cooking program, (u) a degree of opening of a cooking chamber door, (v) a frequency of opening of a cooking chamber door, and (w) duration of opening of a cooking chamber door.

9. The method of claim 8, wherein (r) a temperature of the cooking product in the cooking chamber comprises a core temperature of the cooking product in the cooking chamber.

10. The method of claim 1, further comprising retrieving at least one first parameter stored for the type of cooking product i, the first parameter used for the determination of at least one of the cooking chamber climate and the point in time $t_4$.

11. The method of claim 10, further comprising selecting the first parameter from the group consisting of a temperature in the cooking chamber, a humidity in the cooking chamber, and a circulation of the cooking chamber atmosphere.

12. The method of claim 10, further comprising retrieving at least one second parameter that was stored for each cooking level k.

13. The method of claim 12, comprising selecting the second parameter from the group consisting of a temperature in the cooking chamber, a humidity in the cooking chamber, and a circulation of the cooking chamber atmosphere in the cooking chamber.

14. The method of claim 1, wherein selecting and inputting the type of cooking product i occurs in at least two selection stages.

15. The method of claim 14, wherein the selection stages comprise at least one first selection stage, wherein at least one larger group is selected, and a second selection stage, wherein at least one subgroup is selected.

16. The method of claim 15, comprising selecting the subgroup from the larger group.

17. The method of claim 15, comprising selecting the larger group from the group consisting of bakery goods, meat, fish, and vegetables.

18. The method of claim 15, comprising the subgroup from the group consisting of bread dough, cake dough, cookie dough, roasts, minced meat, and poultry.

19. The method of claim 1, wherein loading each cooking level k comprises one of re-setting a timer assigned to each cooking level k, and setting to zero a timer assigned to each cooking level k.

20. Method for conducting a cooking program by automatically setting at least one cooking chamber climate in a cooking chamber of a cooking appliance for cooking products introduced into the cooking chamber at various points in time at different cooking levels, wherein different cooking products of different cooking product types can be introduced into the cooking chamber, the method comprising:

(a) selecting and inputting, with an input device of the cooking appliance, a first cooking product and a first cooking level in the cooking chamber;

(b) loading the first cooking level with the first cooking product;

(c) automatically setting a third cooking chamber climate in dependence on the input identifying the first cooking product and the first cooking level;

(d) selecting and inputting, with the input device of the cooking appliance, a second cooking product and a second cooking level in the cooking chamber;

(e) loading the second cooking level with the second cooking product at a point in time after the setting of the third cooking chamber climate;

(f) automatically recalculating and resetting the third cooking chamber climate in dependence on the input identifying the second cooking product and the second cooking level;

(g) automatically outputting a first signal for removing the first cooking product from the cooking chamber after the resetting of the third cooking chamber climate; and (h) automatically outputting a second signal for removing the second cooking product from the cooking chamber after the resetting of the third cooking chamber climate.

21. The method of claim 20, wherein in the event that the cooking chamber is empty at (a), the method further comprises at least one of:

(i) automatically determining a first cooking chamber climate at (a), the first cooking chamber climate determined as a function of all selectable types of a cooking product, or (ii) automatically determining a second cooking chamber climate at a point in time after (a) and before (b), the second cooking chamber climate determined in dependence on the input identifying the type of cooking product and the cooking level.

22. The method of claim 20, wherein in the event that that cooking chamber is at least partially loaded at (a) with cooking product other than the first and second cooking products, the method further comprises at least one of:

(i) automatically determining a fourth cooking chamber climate at (a), the fourth cooking chamber climate determined at least in dependence on the at least partial loading of the cooking levels with the other cooking product at (a), or (ii) automatically determining a fifth cooking chamber climate at a point in time after (a) and before (b), the fifth cooking chamber climate determined in dependence on the at least partial loading of the cooking levels with the other cooking product at (a) and the cooking product to be loaded at (b).

* * * * *

UNITED STATES PATENT AND TRADEMARK OFFICE

CERTIFICATE OF CORRECTION

PATENT NO. : 8,147,888 B2
APPLICATION NO. : 12/279962
DATED : April 3, 2012
INVENTOR(S) : Kling et al.

It is certified that error appears in the above-identified patent and that said Letters Patent is hereby corrected as shown below:

In the Claims

In Column 10, Line 4, in Claim 22, delete “that that” and insert -- that the --, therefor.

Signed and Sealed this
Second Day of September, 2014

Michelle K. Lee

Michelle K. Lee
*Deputy Director of the United States Patent and Trademark Office*